US007939986B2

(12) United States Patent
Chandrashekhar et al.

(10) Patent No.: US 7,939,986 B2
(45) Date of Patent: May 10, 2011

(54) BETAVOLTAIC CELL

(75) Inventors: MVS Chandrashekhar, Ithaca, NY (US); Christopher Ian Thomas, Ithaca, NY (US); Michael G. Spencer, Ithaca, NY (US)

(73) Assignee: Cornell Research Foundation, Inc., Ithaca, NY (US)

( * ) Notice: Subject to any disclaimer, the term of this patent is extended or adjusted under 35 U.S.C. 154(b) by 0 days.

(21) Appl. No.: 12/637,463

(22) Filed: Dec. 14, 2009

(65) Prior Publication Data

US 2011/0079791 A1 Apr. 7, 2011

Related U.S. Application Data

(63) Continuation of application No. 11/509,323, filed on Aug. 24, 2006, now Pat. No. 7,663,288.

(60) Provisional application No. 60/711,139, filed on Aug. 25, 2005.

(51) Int. Cl.
*G21H 1/00* (2006.01)

(52) U.S. Cl. ..... 310/303

(58) Field of Classification Search ..... 310/301–303
See application file for complete search history.

(56) References Cited

U.S. PATENT DOCUMENTS

| | | | |
|---|---|---|---|
| 2,998,550 | A | 8/1961 | Collins et al. |
| 4,010,534 | A | 3/1977 | Anthony et al. |
| 5,079,469 | A | 1/1992 | Bongianni |
| 5,260,621 | A | 11/1993 | Little et al. |
| 5,396,141 | A | 3/1995 | Jantz et al. |
| 5,436,174 | A | 7/1995 | Baliga et al. |
| 5,859,484 | A | 1/1999 | Mannik et al. |
| 6,118,204 | A | 9/2000 | Brown |
| 6,686,534 | B2 | 2/2004 | Chen |
| 6,774,531 | B1 | 8/2004 | Gadeken |
| 6,900,477 | B1 | 5/2005 | Shah |
| 6,949,865 | B2 | 9/2005 | Gadeken |
| 7,183,127 | B2 | 2/2007 | Kuriyama et al. |
| 7,663,288 | B2 * | 2/2010 | Chandrashekhar et al. .. 310/303 |
| 2002/0017650 | A1 | 2/2002 | Nikolaev et al. |
| 2007/0080605 | A1 | 4/2007 | Chandrashekhar et al. |

FOREIGN PATENT DOCUMENTS

WO WO-2004/068548 8/2004

OTHER PUBLICATIONS

"U.S. Appl. No. 11/509,323, Non-Final Office Action mailed Dec. 30, 2008", 15 pgs.
"U.S. Appl. No. 11/509,323, Response filed Oct. 30, 2008 to Restriction Requirement", 9.
"U.S. Appl. No. 11/509,323, Notice of Allowance mailed Sep. 14, 2009", 5 Pgs.
"U.S. Appl. No. 11/509,323, Response filed Jun. 1, 2009 to Non Final Office Action mailed Dec. 30, 2008", 10 pgs.
Chandrashekhar, M. V. S., et al., "Demonstration of a 4H SiC Betavoltaic Cell", *Applied Physics Letters*, 88, 033506, (published on-line on Jan. 18, 2006), 3 pgs.
Sun, W., et al., "A Three-Dimensional Porous Silicon p-n Diode for Betavoltaics and Photovoltaics", *Advanced Materials*, 17, (2005), 1230-1235.

* cited by examiner

*Primary Examiner* — Thomas M Dougherty
(74) *Attorney, Agent, or Firm* — Schwegman, Lundberg & Woessner, P.A.

(57) ABSTRACT

High aspect ratio micromachined structures in semiconductors are used to improve power density in Betavoltaic cells by providing large surface areas in a small volume. A radioactive beta-emitting material may be placed within gaps between the structures to provide fuel for a cell. The pillars may be formed of SiC. In one embodiment, SiC pillars are formed of n-type SiC. P type dopant, such as boron is obtained by annealing a borosilicate glass boron source formed on the SiC. The glass is then removed. In further embodiments, a dopant may be implanted, coated by glass, and then annealed. The doping results in shallow planar junctions in SiC.

29 Claims, 5 Drawing Sheets

BETAVOLTAIC CELL

RELATED APPLICATION

This application is a continuation of U.S. patent application Ser. No. 11/509,323, filed Aug. 24, 2006, which claims priority to U.S. Provisional Application Ser. No. 60/711,139 (entitled BETAVOLTAIC CELL, filed Aug. 25, 2005) which applications are incorporated herein by reference.

GOVERNMENT FUNDING

The invention described herein was made with U.S. Government support under Contract No W31P4Q-04-1-R002 awarded by Defense Advanced Research Project Agency (DARPA). The United States Government has certain rights in the invention.

BACKGROUND

Modern society is experiencing an ever-increasing demand for energy to power a vast array of electrical and mechanical devices. Since the invention of the transistor, semiconductor devices that convert the energy of nuclear particles or solar photons to electric current have been investigated. Two dimensional planar diode structures have been used for such conversion. However, such two dimensional structures exhibit a number of inherent deficiencies that result in relatively low energy-conversion efficiencies.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description is, therefore, not to be taken in a limited sense, and the scope of the present invention is defined by the appended claims.

Three dimensional semiconductor based structures are used to improve power density in betavoltaic cells by providing large surface areas in a small volume. A radioactive emitting material may be placed on and/or within gaps in the structures to provide fuel for a cell. The characteristics of the structures, such as spacing and width of protrusions may be determined by a self-absorption depth in the radiation source and the penetration depth in the semiconductor respectively.

In one embodiment, the semiconductor comprises silicon carbide (SiC), which is suitable for use in harsh conditions due to temperature stability, high thermal conductivity, radiation hardness and good electronic mobility. The wide bandgap of 4H hexagonal polytype (3.3 eV) provides very low leakage currents.

In one embodiment, SiC pillars are formed of n-type SiC. P or n type dopants may be formed on the pillars or any SiC structure in various known manners. In one embodiment, p-type doping utilizes a borosilicate glass boron source formed on the pillars. The borosilicate glass may then be removed, such as by immersion in hydrofluoric acid followed by a deionized water rinse or by plasma etch. Both substitutional and vacancy mediated diffusion occurs. Other boron sources, such as boron nitride or any other boron-containing ceramic may be used in place of the borosilicate glass. The doping results in shallow planar p-n junctions in SiC.

The following text and figures describe one embodiment utilizing high aspect ratio micromachined pillars in semiconductors. The formation of PN junctions and provision of a radioactive beta-emitting material may be placed within gaps between the pillars to provide fuel for a cell are also described. A method for doping SiC is then described that utilizes an easily removable sacrificial layer. Some example results and calculations are then described.

Figure 1A:
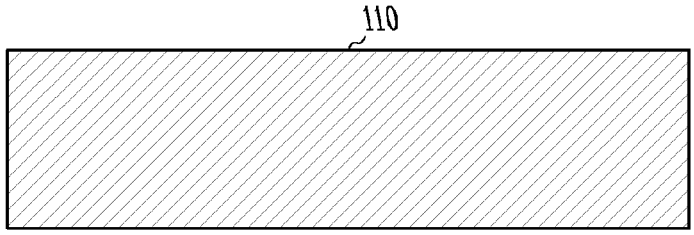
FIGS. 1A, 1B, 1C, 1D and 1E illustrate steps involved in forming a Betavoltaic cell according to an example embodiment.
Figure 1B:
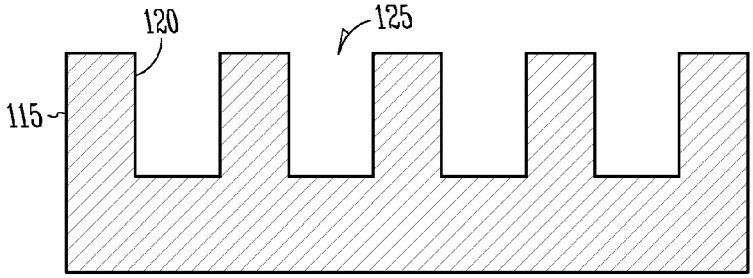
Figure 1C:
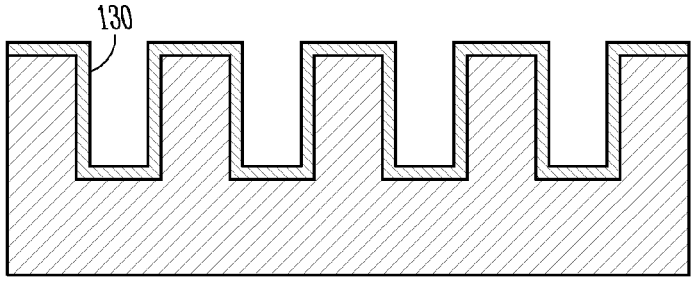

FIGS. 1A, 1B, 1C, 1D and 1E illustrate formation of an example betavoltaic cell. In one embodiment, a silicon carbide substrate 110 is used. Other semiconductor substrates may be used if desired, such as silicon. Photolithography and etching may be used to provide a structure 115 that has a larger surface area than a smooth substrate as shown in FIG. 1B. In one embodiment, the structure 115 comprises etched pillars 120 separated by gaps 125 between the pillars. Standard plasma etching techniques may be used to provide good control over sidewall profiles of the etched pillars 120. The roughness of the sidewalls resulting from electrochemical etching may provide traps for current flow. Photolithography may be used to pattern high aspect ratio pillars, yielding good control over the geometry of the device. This allows for better optimization of power conversion efficiency, and also may lead to better process control in commercialization.

To form the pillars in one embodiment, a semiconductor wafer is patterned using standard photolithography techniques. The pattern is then transferred using plasma etching techniques such as electron cyclotron resonance (ECR) etching. These techniques can etch deep with good control over the sidewall profile, allowing for the realization of high aspect ratio structures.

Figure 2:
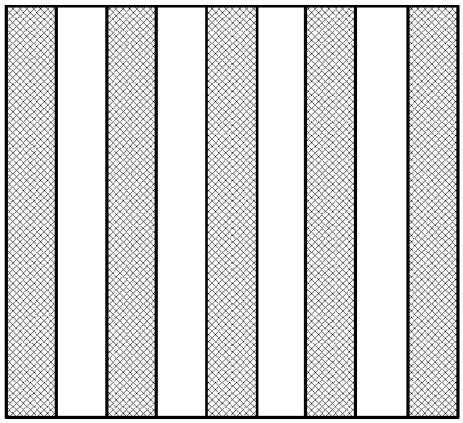
FIG. 2 is an alternative structure for a Betavoltaic cell according to an example embodiment.
Figure 3:
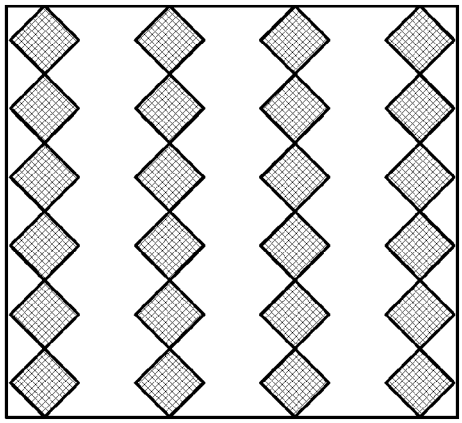
FIG. 3 is a further alternative structure for a Betavoltaic cell according to an example embodiment.

Other structures may also be used such as stripes 210 in FIG. 2 and scalloped stripes 310 in FIG. 3. In a further embodiment, pores in a semiconductor substrate may formed with junctions to form a porous three dimensional porous silicon diode having conformal junctions. Pore sizes may range from less than 2 nm to greater than 50 nm. Just about any structure that increases the surface area of the resulting battery may be used. High aspect ratio structures that may be doped to provide shallow junctions tend to provide the greatest increase in power density.

Using the high aspect ratio pillars to form shallow junctions may lead to higher power densities over planar approaches. By etching through a typical half millimeter thick wafer, using a Tritium radiation source, this approach may yield power density increases of up to or more than 500 times planar or two dimensional approaches.

Figure 1D:
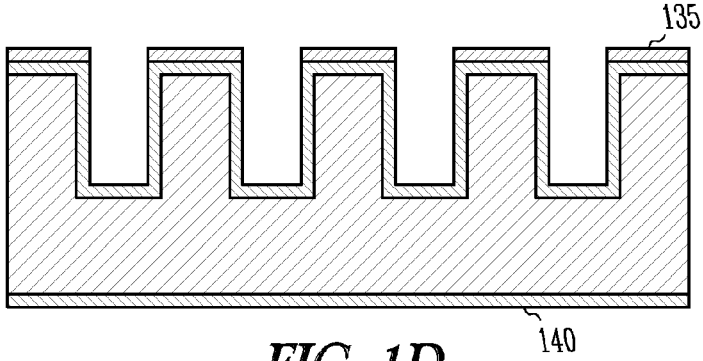
Figure 1E:
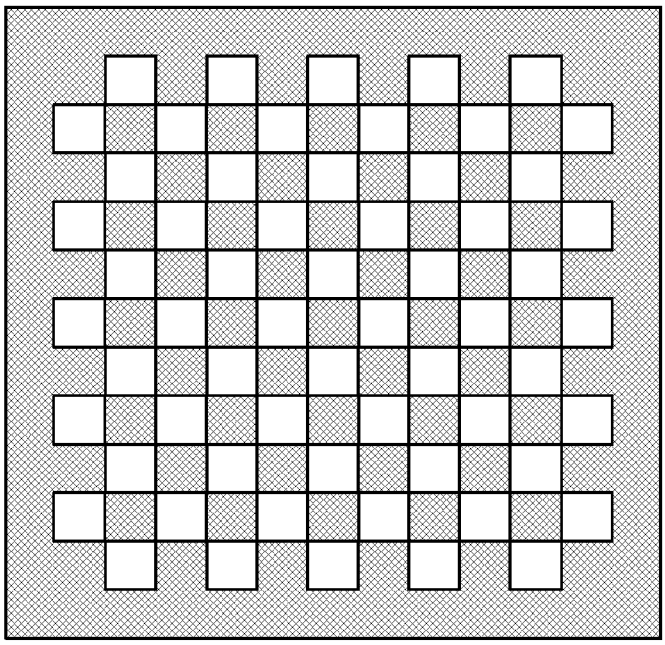

Either solid source or gas source diffusion may be used to diffuse impurities 130 into the etched pillars 120, forming a p-n junction over substantially the entire length of the pillar or surface of the structure. Ohmic contacts 135, 140 compatible with the semiconductor, such as aluminum are deposited as shown in FIG. 1D. In one embodiment, contacts are formed on the tops of the pillars as indicated at 135, and on the bottom side of the substrate as indicated at 140. These serve as a cathode and anode for the resulting cell or battery. FIG. 1E provides a planar view of contact layout to minimize series resistance and simplify packaging. The device can then be mounted in a package and interfaced with the external world via wire-bonding.

Figure 4:
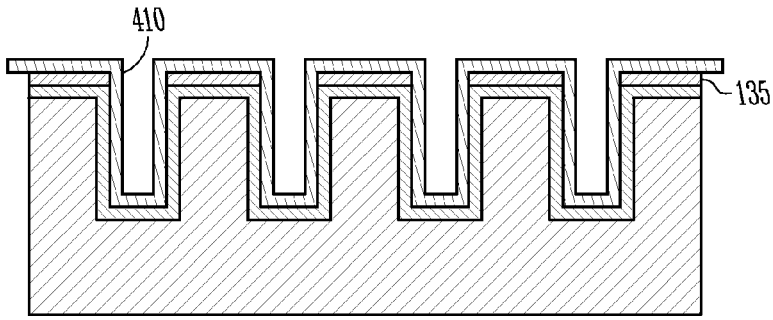
FIG. 4 is an illustration of the addition of fuel to a Betavoltaic cell according to an example embodiment.

Gaps between the pillars may be filled with radioactive fuel, such as tritiated water ($T_2O$), Ni-63 or other beta emitting source, such as promethium as indicated 410 in FIG. 4. In one embodiment, a metal radioactive source such as Ni-63 may be introduced by electroless/electroplating or evaporation techniques. In further embodiments, the source may be introduced before contact formation. The package can then be sealed or left open for characterization purposes. Aspect rations of up to 10:1 or higher, such as the entire thickness of the wafer, may be utilized.

Figure 5A:
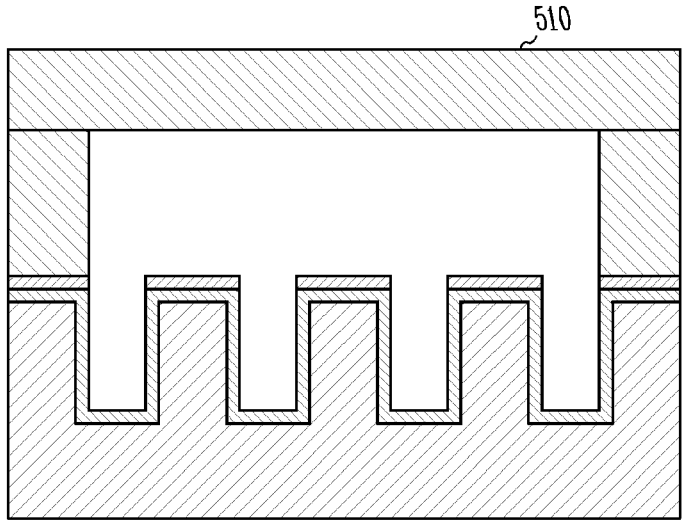
FIGS. 5A and 5B are diagrams illustrating the use of fluid fuel according to an example embodiment.
Figure 5B:
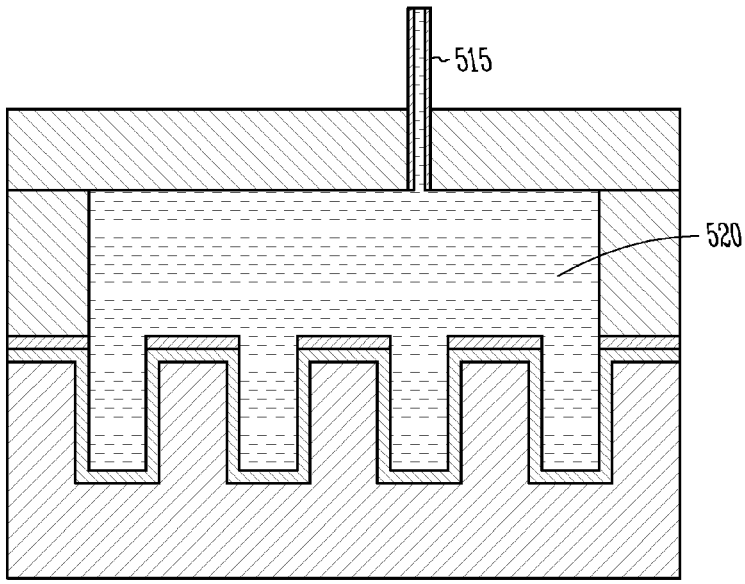

In a further embodiment as illustrated in FIGS. 5A and 5B, the fuel may take the form of a fluid-liquid or gas, such as $T_2O$ or solutions of radioactive salts. A cap 510 or container is formed on a cell 515, such as the cell illustrated in FIGS. 1A-1E. The cap may be formed using many different semiconductor techniques, such as PDMS, SU8, etc. A capillary or other fill device 515 may be used to introduce the fluid fuel into a resulting chamber 520. In further embodiments, the fluid fuel can be introduced by injection or otherwise.

In further embodiments, a graded junction may be grown by crystal growth techniques, such as chemical vapor deposition (CVD) or implemented by diffusion from solid or gaseous sources on a planar semiconductor substrate, or by ion implantation as described below. The graded junction can then be etched to form high aspect ratio junctions. Batteries with power density of ~5 mW/cm2 over a period of 20 years may be obtained. These may be useful to power sensors in low accessibility areas, such as pacemakers, sensor nodes in bridges, tags in freight containers and many other applications.

In one embodiment, the pillars are approximately 1 um in width, with approximately 1 um between them. They may be 5 um to 500 um deep, or deeper, depending on the thickness of the substrate. The dimensions may vary significantly, and may also be a function of the self-absorption depth in the radiation source and the penetration depth in the semiconductor respectively.

In one embodiment, the semiconductor comprise silicon carbide (SiC), which is suitable for use in harsh conditions due to temperature stability, high thermal conductivity, radiation hardness and good electronic mobility. The wide bandgap of 4H hexagonal polytype (3.3 eV) provides very low leakage currents.

In one embodiment, SiC pillars are formed of n-type SiC. P type dopant, such a boron is performed from a borosilicate glass boron source formed on the pillars. The borosilicate glass may then be removed, such as by immersion in hydrofluoric acid followed by a deionized water rinse or by plasma etch. Both substitutional and vacancy mediated diffusion occurs. The doping results in shallow planar p-n junctions in SiC. Doping levels in one embodiment are approximately $1\times10^{15}$ $cm^{-3}$ for the n-type doping, and approximately $1\times10^{17}$ $cm^{-3}$ for the p-type doping. These doping densities may vary significantly in further embodiments. In still further embodiments, the pillars may cover substantially the entire wafer. At current densities of approximately 3 nanoamps/$cm^2$, they may be used to form batteries with significant power capabilities. In still further embodiments, the pillars may be p-type and the dopant formed on the pillars may be n-type to form junctions.

In one example, a dopant glass, such as Borosilicate glass, PSG, BPSG, etc., is deposited on the SiC pillars and annealed at high temperature, such as ~1600° C. or greater than approximately 1300° C. to drive in the dopants. This process may also be used on any type of SiC structure, including planar substrates for circuit formation. The presence of the glass on the surface, and lower temperature than diffusing from vapor sources, reduces the effect of surface roughening through sublimation. For short diffusions, decomposition of the borosilicate glass appears to be minimal, as is surface roughening of the SiC. The resulting SiC surfaces may be smooth.

Figure 6A:
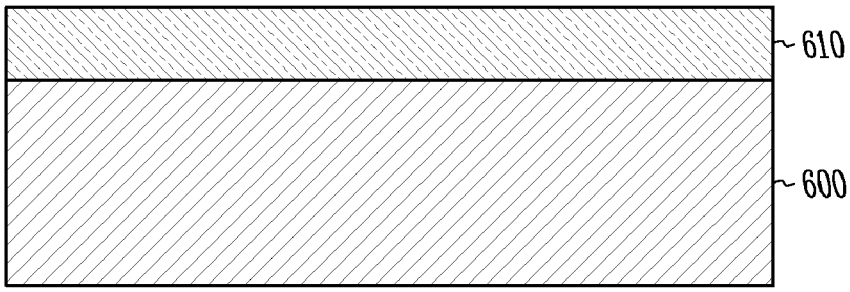
FIGS. 6A, 6B and 6C illustrate the formation of a junction via diffusion according to an example embodiment.
Figure 6B:
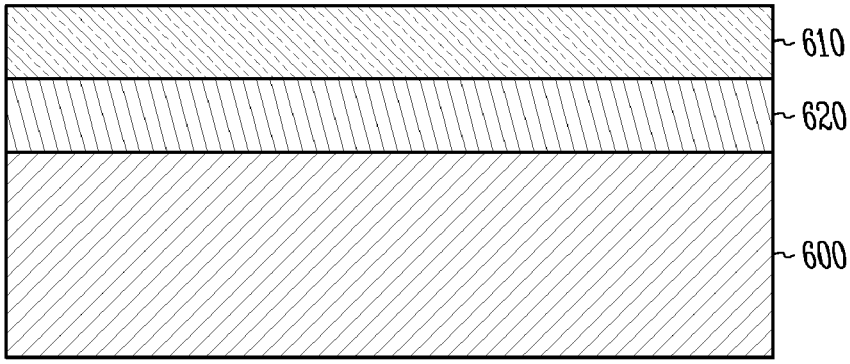
Figure 6C:
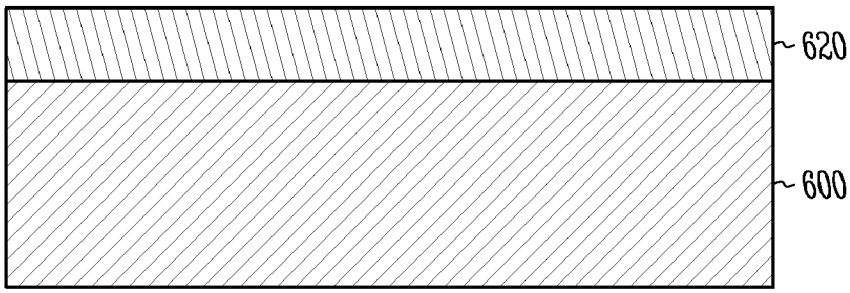

In further embodiments as illustrated in FIGS. 6A, 6B, and 6C, a SiC substrate 600, which may or may not contain structures, is used as a starting point. Dopant glass 610, either p or n-type may be deposited on the SiC either by chemical vapor deposition or spin-on glass methods among other methods. The glass coated SiC is then annealed, either in vacuum or an ambient to diffuse the boron into the SiC as represented at 620, from approximately 1300° C. to approximately 1800° C. The glass 610 may then be removed by immersion in hydrofluoric acid followed by a deionized water rinse or by a plasma etch.

In a further embodiment, dopant containing glass can be deposited on the SiC using a plasma enhanced chemical vapor deposition (PECVD). It may then be annealed in a vacuum at approximately greater than 1300° C. and removed by immersion in hydrofluoric acid followed by a deionized water rinse or by a plasma etch. Other boron sources, such as boron nitride or any other boron-containing ceramic may be used in place of the borosilicate glass to obtain p-type doping.

It should be noted that glass was originally believed to be unstable at such high temperatures based on Si data. However, on SiC, it remains stable enough for this sacrificial application. Temperatures below 1300° C. may provide some drive in of dopants, and may be included in the phrase approximately greater than in some embodiments.

Figure 7A:
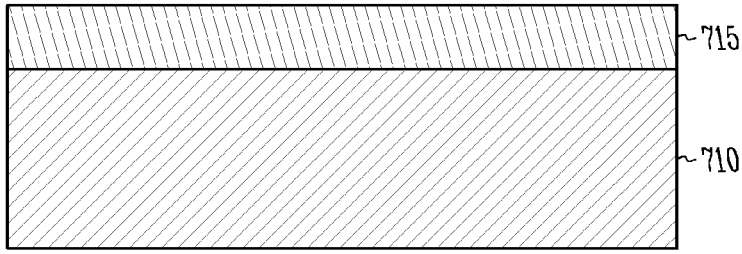
FIGS. 7A, 7B, 7C and 7D illustration the formation of a junction via ion implantation according to an example embodiment.
Figure 7B:
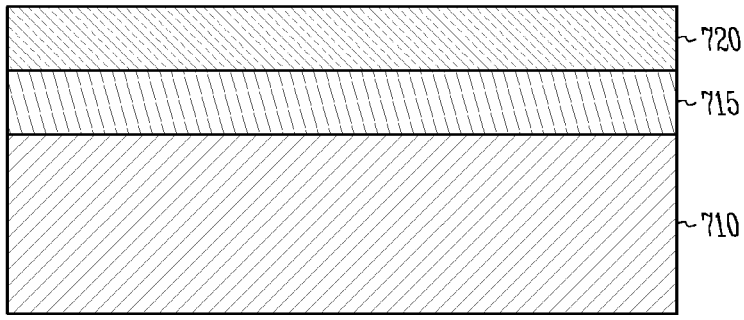
Figure 7C:
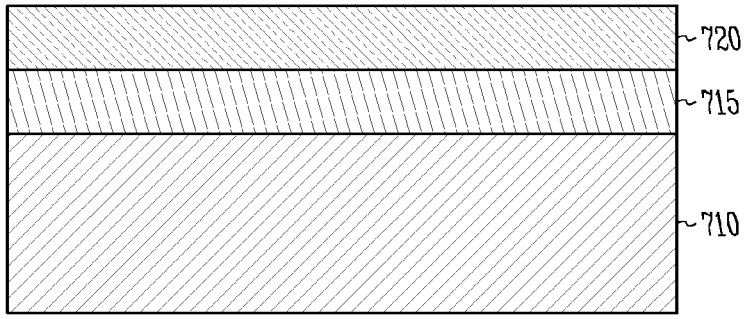
Figure 7D:
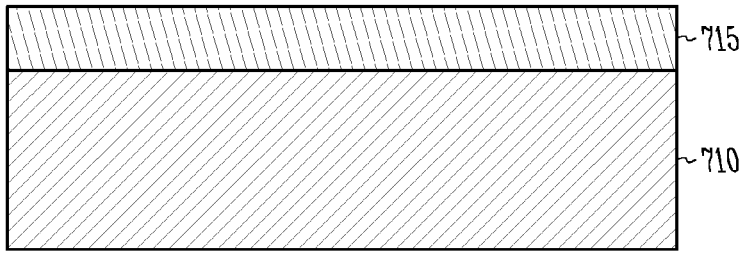

FIGS. 7A, 7B, 7C, and 7D illustrate formation of a pn junction by ion implantation. A SiC substrate 710 in FIG. 7A is implanted with dopant 715, such as boron. Other p and n-type dopants may also be used. A glass 720 is then deposited on top of the implanted substrate as seen in FIG. 7B. An activation anneal is performed as illustrated in FIG. 7C, to activate the dopant, such as by ensuring dopants achieve proper locations within the crystalline lattice structure of the SiC. In FIG. 7D, the glass may be removed by acid, such as HF, or plasma etch.

In one embodiment, the boron doped SiC forms a betavoltaic cell as described above. 4H SiC may be used in one embodiment. The p-n diode structure may be used to collect the charge from a 1 mCi Ni-63 source located between the pillars. The following results are provided for example only and may vary significantly dependent upon the actual structure used. An open circuit voltage of 0.72V and a short circuit current density of 16 nA/$cm^2$ were measured in a single p-n junction. An efficiency of 5.76% was obtained. A simple photovoltaic-type model was used to explain the results. Fill factor and backscattering effects were included in the efficiency calculation. The performance of the device may be limited by edge recombination.

Silicon carbide (SiC) is a wide bandgap semiconductor that has been used for high power applications in harsh conditions due to its temperature stability, high thermal conductivity, radiation hardness and good electronic mobility. The wide bandgap of the 4H hexagonal polytype (3.3 eV) provides very low leakage currents. This is advantageous for extremely low power applications. The availability of good quality substrates, along with recent advances in bulk and epitaxial growth technology, allow full exploitation of the properties of SiC.

Radioactive isotopes emitting β-radiation such as Ni-63 and tritium (H-3) have been used as fuel for low power batteries. The long half-lives of these isotopes, their insensitivity to climate, and relatively benign nature make them very attractive candidates for nano-power sources.

The radiation hardness of SiC[4] ensures the long-term stability of a radiation cell fabricated from it. A 4H SiC p-n diode may be used as a betavoltaic radiation cell. Due to its wide bandgap, the expected open circuit voltage and thus realizable efficiency are higher than in alternative materials such as silicon.

The operation of a radiation cell is very similar to that of a solar cell. Electron-hole (e-h) pairs are generated by high-energy β-particles instead of photons. These generated carriers are then collected in and around the depletion region of a diode and give rise to usable power. The dynamics of high-energy electron stopping in semiconductors are well known, with about ⅓ of the total energy of the radiation generating usable power through the creation of electron hole pairs. The remaining energy is lost through phonon interactions and X-rays. A mean "e-h pair creation energy or effective ionization parameter" in a semiconductor, takes into account all possible loss mechanisms in the bulk for an incident high-energy electron. This e-h pair creation energy is treated as independent of the incident electron energy. The effective ionization energy was calculated to be 8.4 eV for 4H SiC[5].

In one embodiment, doping values of $10^{16}$ $cm^{-3}$ and 100% charge collection efficiency (CCE) were assumed. Calculations were performed for a 4 mCi/$cm^2$ nickel-63 radiation source corresponding to an ideal incident β-electron current density of 20 pA/$cm^2$, which was the source used in this work. Backscattering losses and fill factor effects are included in these calculations. The expected performance for ideal junctions (ideality factor n=1) is compared with junctions where current transport is dominated by depletion and/or edge and surface recombination (n=2). The performances realized in SiC in this work and in silicon previously are compared below.

A p+ 4H SiC <0001> substrate cut 8° off-axis purchased from Cree Inc. was used in this study. A 4 μm thick active p layer background doped at $3\times10^{15}$ $cm^{-3}$, followed by a 0.25 μm thick n layer nitrogen doped at $2\times10^{18}$ $cm^{-3}$, were grown by chemical vapor deposition (CVD) at 1600° C. and 200 Torr at a nominal growth rate of 2.5 μm/hr. Silane and propane were used as precursors with hydrogen as the carrier gas. The thickness of the active layer was chosen to match the average penetration depth of β-electrons from Ni-63 (which is about 3 μm), in order to provide good charge collection. All doping levels were experimentally determined by capacitance-voltage measurements.

Test diodes (500×500 $\mu m^2$) were patterned by photolithography and isolated by electron cyclotron resonance (ECR) etching in chlorine ($Cl_2$). Backside Al/Ti contacts were evaporated by an electron beam in vacuum. They were then annealed at 980° C. to render them ohmic. 50×50 $\mu m^2$ nickel contacts occupying only 1% of the active device area were then patterned and annealed at 980° C. in order to minimize backscattering losses from the high Z metal.

A LEO DSM982 scanning electron microscope (SEM) at an accelerating voltage of 17 kV (corresponding to the mean energy of β-electrons from Ni-63) and a current of 0.72 nA was used to simulate an intense radiation source. An electrical feed-through connected to a probe tip was used to contact the isolated devices. The substrate was contacted to the stage with copper tape. The incident beam current density was varied by running the SEM in TV mode and changing the effective illumination area with constant beam current. The open circuit voltage (Voc) and short circuit current (Isc) were measured as a function of the incident beam current density $J_{beam}$.

In separate measurements, a 1 mCi Ni-63 source placed 6 mm from the devices was used to test the cell in air. The measured output current density of the source was 6 pA/$cm^2$. The output of the cell was monitored for a period of one week.

The leakage currents of the diodes were extracted from the forward active region of the current voltage (IV) characteristic. A typical value of the leakage current was $J_0=10^{-12}$ A/$cm^2$ with an ideality factor of n=3 for 500 μm square diodes. The n=3 behavior is believed to be an artifact from high resistance contacts. A few of the diodes exhibited leakage currents of ~$10^{-17}$ A/$cm^2$ with an ideality of n=2. The diodes were uniform in their characteristics, with the exception of those exhibiting n=2 behavior.

Voc and Jsc are connected by the well-known photovoltaic relation derived from the diode equation with constant electron-hole pair generation, $$Voc = nV_{th}\ln\left(\frac{Jsc}{J_0}\right) \text{ for } Jsc >> J_0 \tag{1}$$

where $J_0$ is the reverse leakage current density of the diode, $V_{th}$ is the thermal voltage and n is the ideality factor. The voltage thus calculated from equation (1) using the measured value of $J_0$ is 0.76 V for the Ni-63 source. There is good agreement between the open circuit voltage extracted from the above equation and the 0.72 V measured under β-electron illumination. Furthermore, the dependence of Voc on the illumination current density also exhibits an ideality of n=3, suggesting that the betavoltaic cell does indeed function in a manner analogous to a photovoltaic cell. The radiation cell was thus modeled with the following simple equation for a 500×500 $\mu m^2$ diode:

$$P = IV = I_0\left(\exp\left(\frac{V}{nV_{th}}\right)-1\right)V - IscV \cong I_0\left(\exp\left(\frac{V}{nV_{th}}\right)\right)V - IscV \text{ for } Isc >> I_0 \tag{2}$$

where P is the power obtained from the cell. We have used $I_0=(25\times10^{-4})(1\times10^{-12})$ A, n=3 and $Isc=(25\times10^{-4})(16\times10^{-9})$A for one example device. Series resistance is neglected in equation (2) as the currents being dealt with are so low.

The current multiplication factor under monochromatic electron illumination is ~1000, which is less than the total 2000 predicted by Klein's model. This is believed to stem from surface recombination, an effect well documented for SiC diodes. It was observed that when the illumination area was far from the edges of the diode, confined to its center, the current multiplication factor was ~2000 vs. 1000 for blanket illumination, indicating that edge and surface recombination play a role in reducing collection efficiency despite the relatively large size of the devices (500×500 $\mu m^2$). The highest efficiency of 14.5% and a current multiplication factor of ~2000 were observed for an illumination area smaller than the area of the diode. It is thus expected that surface passivation techniques may improve the efficiency of the cell.

Under Ni-63 irradiation, however, an enhancement in current multiplication to ~2400 was observed. This is believed to stem from the details of the distribution characteristics of the β-radiation compared with monochromatic SEM electron illumination. No change in the open circuit voltage or short circuit current was observed during the one-week monitoring period, indicating that radiation damage did not occur over that time. This is consistent with the radiation damage threshold in SiC[4].

The overall efficiency of the radiation cell may be computed from $$\text{Efficiency} = FF\frac{VocJsc}{V_{mean}J_{beam}} \tag{3}$$

where $$FF = \frac{V_p J_p}{VocJsc} \tag{4}$$

where $V_p$ and $J_p$ are the voltage and current density at the maximum power point, respectively. These were calculated numerically from equation (2) or directly from the measured data in FIG. 2*c*). $V_{mean}$=17 kV corresponds to the average energy of a β-particle from Ni-63 (17 keV) and $J_{beam}$ is the current density from the radiation source or from the SEM. Table 1 shows a comparison of the values of various salient parameters obtained by measurement and extraction from the model in equation (2). Fairly good correspondence is seen with the model despite the fact that the Ni-63 irradiation measurement was performed in air, implying that our model is an adequate first order description of the radiation cell. The discrepancy of the fill factor at the low currents from Ni-63 is believed to have arisen from suboptimal tunneling contacts. The measured fill factors approached their ideal values at currents >80 nA/$cm^2$.

TABLE 1

| Parameter | Measured | Model |
|---|---|---|
| Jo (A/$cm^2$) | $1 \times 10^{-12}$ | Used measured value |
| n | 3 | Used measured value |
| Jsc (A/$cm^2$) | $1.6 \times 10^{-8}$ | Used measured value |
| Voc (V) | 0.72 | 0.76 |
| Vp (V) | 0.60 | 0.60 |
| Jp (A/$cm^2$) | $0.98 \times 10^{-8}$ | $1.38 \times 10^{-8}$ |
| FF | 0.51 | 0.68 |

Despite the low currents from the Ni-63 source, devices were obtained with a voltage of 0.72V and an efficiency of 5.76%, which can be used directly in circuits. By comparison, the use of silicon, which gives much lower voltages (~100 $m^3$), necessitates multiple cells in series for usable power, complicating device geometry. Leakage currents as low as $10^{-24}$ A/$cm^2$ have been reported for SiC PN junctions. With leakage currents of ~$10^{-24}$ A/$cm^2$ and n=2, one can expect a voltage of ~1.93 V and an efficiency of ~13%.

The Abstract is provided to comply with 37 C.F.R. §1.72(b) to allow the reader to quickly ascertain the nature and gist of the technical disclosure. The Abstract is submitted with the understanding that it will not be used to interpret or limit the scope or meaning of the claims.

The invention claimed is:

1. A Betavoltaic cell comprising:
a SiC substrate;
structures formed of semiconductor, wherein the structures comprise p-n junctions, and wherein there are voids proximal to the structures; and
electrical contacts formed on the structures, wherein the contacts are adapted to minimize beta radiation backscatter losses.

2. The Betavoltaic cell of claim 1 and further comprising a beta radiation source.

3. The Betavoltaic cell of claim 2 wherein the beta radiation source is disposed on the surface of the structures.

4. The Betavoltaic cell of claim 2 wherein the beta radiation source comprises Ni-63, or tritium (H-3), or Promethium, or combinations thereof.

5. The Betavoltaic cell of claim 1 wherein the contacts occupy about 1% of an active device area of the p-n junctions.

6. The Betavoltaic cell of claim 2 wherein the radiation source comprises beta radiation producing particles and wherein a semiconductor surface area for accepting the radioactive particles is smaller than an overall device surface area.

7. The Betavoltaic cell of claim 1 wherein the p-n junctions are formed from n doped semiconductor disposed underneath p doped semiconductor or a p doped semiconductor disposed underneath n doped semiconductor.

8. The Betavoltaic cell of claim 1 wherein the structures are formed of high aspect ratio SiC.

9. The Betavoltaic cell of claim 1 wherein the aspect ratio of the structures is at least 10:1.

10. The Betavoltaic cell of claim 1 wherein the aspect ratio of the structures is at least 500:1 or less.

11. The Betavoltaic cell of claim 1 wherein the structures comprise pillars.

12. A Betavoltaic cell comprising:
a semiconductor substrate;
at least one p-n junction formed of semiconductor; and
at least one contact electrically coupled to the at least one p-n junction, wherein the at least one contact is adapted to minimize beta radiation backscatter losses.

13. The Betavoltaic cell of claim 12 and further comprising a beta radiation source.

14. The Betavoltaic cell of claim 13 and further comprising at least one structure formed of semiconductor.

15. The Betavoltaic cell of claim 14 wherein the beta radiation source is disposed on the surface of the at least one structure.

16. The Betavoltaic cell of claim 13 wherein the beta radiation source comprises Ni-63, or tritium (H-3), Promethium, or combinations thereof.

17. The Betavoltaic cell of claim 12 wherein the at least one contact occupies about 1% of an active device area of the p-n junctions.

18. The Betavoltaic cell of claim 12 wherein the at least one p-n junction is formed from n doped semiconductor disposed underneath p doped semiconductor or a p doped semiconductor disposed underneath n doped semiconductor.

19. A Betavoltaic cell comprising:
a SiC substrate;
high aspect ratio pillars supported by the substrate having voids between the pillars;

cathode or anode contacts formed on the pillars, wherein the cathode or anode contacts are adapted to minimize beta radiation backscatter losses;

an anode or cathode contact formed on a back side of the substrate; and a beta radiation fuel disposed in the voids.

20. The Betavoltaic cell of claim 19 wherein the beta radiation fuel comprises Ni-63, or tritium (H-3), or Promethium or combinations thereof.

21. The Betavoltaic cell of claim 19 wherein the high aspect ratio pillars are formed from n doped semiconductor disposed underneath p doped semiconductor or a p doped semiconductor disposed underneath n doped semiconductor.

22. A Betavoltaic cell comprising:

a semiconductor substrate;

structures formed of semiconductor, wherein the structures comprise p-n junctions, and wherein there are voids proximal to the structures;

cathode or anode contacts formed on the structures, wherein the cathode or anode contacts are adapted to minimize beta radiation backscatter losses;

an anode or cathode contact formed on a back side of the substrate; and a cap formed of semiconductor.

23. The Betavoltaic cell of claim 22 and further comprising a beta radiation source in the voids.

24. The Betavoltaic cell of claim 23 wherein the beta radiation source comprises Ni-63, or tritium (H-3), or Promethium, or combinations thereof.

25. The Betavoltaic cell of claim 22 wherein the p-n junctions are formed from n doped semiconductor disposed underneath p doped semiconductor or a p doped semiconductor disposed underneath n doped semiconductor.

26. The Betavoltaic cell of claim 22 wherein the structures are formed of high aspect ratio SiC.

27. The Betavoltaic cell of claim 22 wherein the aspect ratio of the structures is approximately 10:1 or less.

28. The Betavoltaic cell of claim 22 wherein the aspect ratio of the structures is approximately 500:1 or less.

29. The Betavoltaic cell of claim 22 wherein the structures comprise pillars.

* * * * *

UNITED STATES PATENT AND TRADEMARK OFFICE

CERTIFICATE OF CORRECTION

PATENT NO. : 7,939,986 B2
APPLICATION NO. : 12/637463
DATED : May 10, 2011
INVENTOR(S) : MVS Chandrashekhar et al.

It is certified that error appears in the above-identified patent and that said Letters Patent is hereby corrected as shown below:

In column 7, lines 62-63, delete "(~100m$^3$)," and insert -- (~100mV$^3$), --, therefor.

Signed and Sealed this
Fifth Day of July, 2011

David J. Kappos

David J. Kappos
*Director of the United States Patent and Trademark Office*